US005469902A

United States Patent [19]

Sharp et al.

[11] Patent Number: 5,469,902

[45] Date of Patent: Nov. 28, 1995

[54] CHIPPER KNIFE AND KNIFE HOLDER ASSEMBLY

[75] Inventors: Gary A. Sharp, Clearwater, Fla.; Jan-Erik Jonsson, Atlanta, Ga.

[73] Assignee: American Knife, Inc., Appleton, Wis.

[21] Appl. No.: 265,771

[22] Filed: Jun. 27, 1994

Related U.S. Application Data

[63] Continuation-in-part of Ser. No. 119,310, Sep. 13, 1993, abandoned.

[51] Int. Cl.[6] ..... B27G 13/00; B27C 1/00

[52] U.S. Cl. ..... 144/241; 144/176; 144/218; 241/92; 241/298; 407/47; 407/49; 407/113

[58] Field of Search ..... 144/162 R, 172, 144/174, 176, 218, 230, 240, 241; 241/92, 298, 292.1, 294; 407/47, 49, 112, 113

[56] References Cited

U.S. PATENT DOCUMENTS

| | | | |
|---|---|---|---|
| 3,981,337 | 9/1976 | Sundstrom | 144/241 |
| 4,194,545 | 3/1980 | Kostermeier | 144/230 |
| 4,462,725 | 7/1984 | Satran et al. | 407/113 |
| 4,694,995 | 9/1987 | Holmberg et al. | 241/92 |
| 4,784,337 | 11/1988 | Nettles et al. | 144/241 |
| 4,907,631 | 3/1990 | Krautzberger | 144/230 |
| 4,997,018 | 3/1991 | Carpenter et al. | 144/241 |

*Primary Examiner*—W. Donald Bray

[57] ABSTRACT

A chopper has a straight knife clamped between a clamping member and a counter knife. The knife, clamping member, and counter knife are collectively positioned in a machined area formed in a holder that is in turn fitted within a larger recess formed in a chopping disk. A first fastener secures the knife holder to the chopping disk, a second fastener secures the clamping member to the knife holder, and a third fastener secures the counter knife to the knife holder. A projection formed in the counter knife engages a groove formed in the knife to properly align the knife and to inhibit entry of fibers into the space between the counter knife and the knife. The holder further includes a series of steps that position the counter knife and the clamping member, respectively, with respect to the holder.

13 Claims, 1 Drawing Sheet

CHIPPER KNIFE AND KNIFE HOLDER ASSEMBLY

This disclosure is a continuation-in-part of Ser. No. 08/119,310, filed Sep. 13, 1993, by the same inventor, now abandoned.

BACKGROUND OF THE INVENTION

1. Field of the Invention

This invention relates to improvements in chipper knives and knife holder assemblies.

2. Description of the Prior Art

Chippers are machines capable of chipping various sizes and types of wood species into particles known generally as chips. The chips are used, primarily, as raw material for pulp manufacturing.

The wood species that are cut into chips for pulp production vary greatly in size and type, i.e. some woods are very hard and some are very soft.

There are two broad areas of chip production: primary chip manufacturing where chips are cut out of whole log trunks, and secondary chip manufacturing where chips are produced from residual wood, i.e. trimmings from sawmills.

In recent years, disposable or reversible knives have gained acceptance in the industry, but such acceptance has been limited to the secondary chip manufacturing process. Most secondary chipping is done in smaller chippers and the wood is usually softwood in the form of slabs. Thus, the demands or stresses on such knives is less then the demands made on the nonreversible, re-grindable knives used in the primary chip manufacturing process.

Specifically, the knives in the secondary chipping industry have not gained acceptance in the primary chipping industry primarily due to the designs of the knife holder assemblies. The known designs provide very limited clamping area, i.e. only a small part of the surface area of the knife is actually clamped. Thus, a knife having utility in a softwood chipper will fail prematurely when used in a high density hardwood chipper.

More particularly, the known reversible knives are subject to over-torquing when the clamp that holds the knife is tightened down. Due to the small surface area between the knife and the clamp, the clamp springs down more than anticipated and the clamping force is concentrated on the lower heel of the knife at the clamp contact surface abutting the knife. Thus, the upper part of the clamping surface is subjected to a decreased clamping pressure and functional problems occur. For example, wood fibers can enter into the space between a poorly clamped knife and its counter knife, thereby further degrading the performance of the knife.

At the time the present invention was made, it was not obvious to those of ordinary skill in this art how a reversible blade suitable for use in chipping high density whole log trunk hardwood could be developed.

SUMMARY OF THE INVENTION

The longstanding need for a reversible knife having utility in the hardwood chipping industry is now fulfilled. The revolutionary knife design of this invention eliminates the complex structures of earlier knives and clamp mechanisms. It also facilitates knife changing and minimizes the problem of fiber entry between the knife and the counter knife.

The new design is the first reversible knife, anywhere in the world, having utility in the primary chipping industry. The key to this breakthrough is the increased holding area, i.e., clamping surface, on the knives and the improvements in the holding parts. This enables the knives to withstand the forces developed when chipping high density hardwood.

This breakthrough is based primarily upon U.S. Pat. No. 3,981,337 to Sandstrom. However, it represents a major, nonobvious improvement thereover. Moreover, the contact surface area of the novel knife is thirty per cent (30%) greater than that of the Carpenter design (U.S. Pat. No. 4,997,018) and fifty per cent (50%) greater than that of the Holmberg (U.S. Pat. No. 4,694,995) design.

The novel knife is held in sandwiched relation between a clamp which overlies it and a counter knife which underlies it. The design of the knife presents a maximum clamping surface area to said clamp and counter knife to maximize the clamping force applied to the knife.

A crosscut or transverse groove having three surfaces, i.e., a leading surface, a middle surface, and a trailing surface, is formed in the top and bottom surfaces of the knife so that the entire width of a top or first clamping surface of the knife is clamped by the clamp and the entire width of a bottom or second clamping surface is supported by the counter knife. Thus, the only unsupported surface of the knife is a small part of said bottom surface, i.e., that part of the bottom surface that extends from the knife edge to inside the transverse groove.

The counter knife is mounted on a machined surface on a holder which mounts the whole assembly to a chipper disc. A first fastener secures the knife holder to the chipper disk, a second fastener secures the counter knife to the holder, and a third fastener secures the clamp and the knife against the holder and counter knife.

A projecting ridge formed in the counter knife that underlies the knife mates with the transverse groove formed in the knife's opposite clamping surfaces. Thus, the projecting ridge also has three surfaces, i.e., a leading surface, a middle surface, and a trailing surface. The interlocking of the projecting ridge and the transverse groove positions the knife in proper relation to the stationary knife (anvil), and prevents the knife from being pushed into or out of the holder assembly. The leading and trailing surfaces of the transverse groove and hence of the mating projecting ridge are angled at 45 degrees to make the design user friendly; the knife positions itself on the counter knife projecting ridge when clamped.

The flat bottom or middle surface of the groove and the flat top or middle surface of the ridge become a part of the clamping surface as a result of the interlocking of said groove and ridge. Such interlocking also prevents fiber entry between the knife and counter knife. Moreover, after chips are cut by the knife edge, they slide down the exposed knife bevel and across the counter knife. The counter knife changes the chip direction and therefore this area is the most severe wear area. Positioning the ridge in this location adds material to the counter knife, making it stronger, thereby prolonging the life of the counter knife and improving the performance of the entire assembly.

The interlocking of the projecting ridge and the transverse groove also makes possible the use of multiple knife segments. By using multiple knife segments, costs are lowered substantially in many installations. At installations having severe conditions, a full length knife of standard length tends to crack. When using multiple knife segments in one holder assembly, the ridge and groove align the knife edges properly.

To make the novel design more reliable and user friendly, the knife mounting angle on the counter knife and the corresponding angle on the clamp is offset such that 60 to 80% of the clamping force is applied to the upper (radially inward) portion of the knife and 20 to 40% on the lower part (radially outward) at recommended torque. When over torquing, the over torque load is taken up on the lower part of the knife. The designed thickness of the clamp and the length from the lower clamping area to the center of the fastener is such that the clamp will not spring enough to adversely affect the upper clamping of the knife, thereby eliminating the over torque problem.

In applications where space and strength problems are severe, the holder and the counter knife are combined to form one solid piece, i.e., they are integrally formed.

Additional features include a ridge and groove for positioning the counter knife relative to the knife holder, and a series of steps for positioning the clamp within the knife holder.

The novel chipper knife includes a body having a parallelogram shape, said body having a first clamping surface of predetermined width, a second clamping surface of predetermined width, a pair of side walls, a leading surface, a trailing surface, a first cutting edge formed by a predetermined acute angle between said leading surface and said second clamping surface, a second cutting edge formed by a predetermined acute angle between said trailing wall and said first clamping surface, a first transverse groove formed in said first clamping surface, a second transverse groove formed in said second clamping surface, said knife having bilateral symmetry about a longitudinal axis of symmetry, and said knife having bilateral symmetry about a transverse axis of symmetry.

It should therefore be understood that an important object of this invention is to provide a chipper knife and holder assembly of revolutionary design strength.

Many other objects, features, and advantages of the invention will become clear as this description proceeds.

The invention accordingly comprises the features of construction, arrangement of parts, and combination of elements that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the drawings appended hereto, in which.

DETAILED DESCRIPTION OF THE PREFERRED EMBODIMENT

Figure 1:
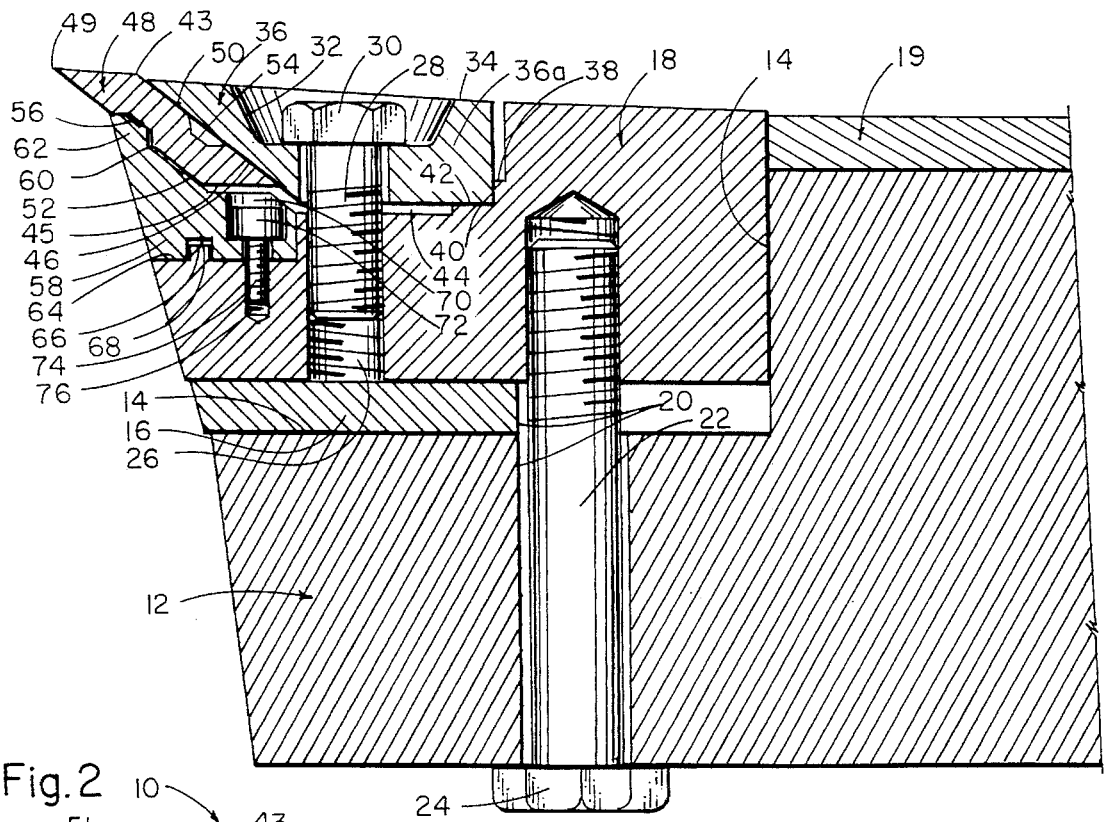
FIG. 1 is a sectional view through part of a chipping disk, showing a first embodiment of the invention.

Referring now to FIG. 1, it will there be seen that a first embodiment of the invention is denoted as a whole by the reference numeral 10. The novel assembly includes rotatably mounted chipper disc 12 having a recess 14 formed therein. An optional spacer 16 is fitted within said recess, as is a holder 18 that surmounts said spacer.

A continuous hole 20 is formed in chopping disk 12, spacer 16, and knife holder 18; the hole is unthreaded in its passage through disc 12 and spacer 16, but internal threads are formed in the part thereof that extends into holder 18.

A fastener 22 having tool-engageable head 24 extends through said hole; its distal end is externally threaded for engaging the threads formed in holder 18. In this manner, holder 18 is firmly secured to chipper disc 12. It should be noted that spacer 16 may not be needed in applications where the size of the holder completely fills recess 14.

A second internally threaded hole 26 is formed in holder 18. Note that hole 26 does not extend into spacer 16 or chipping disk 12; the aforementioned fastener 22 is the only fastener that secures holder 18 to chipping disk 12.

Thus, advancing fastener 28 into hole 26 drives clamp 36 downwardly as head 30 bears against recess 32, thereby securing the clamp to the holder and clamping the knife.

The radially innermost part of clamp 36 is denoted **36*a* for identification purposes, although it is formed integrally with clamp 36. The lowermost, radially innermost part of said part 36*a* is positioned within a unique stepped part of knife holder 18; the first, second, and third steps are denoted 38, 42, and 44, respectively. This series of steps performs the function of holding clamp 36 properly. Surfaces 40 and 42 are contact surfaces for clamp 36*a*. Surface 44 is recessed from surface 42 to accommodate deformation of clamp 36 when fastener 28 is torqued. Surface 38 is recessed from surface 40 to facilitate opening of clamp 36 when changing knife 48**; this makes the system user friendly, i.e., the knife can be changed by unskilled personnel.

In other words, clamp 36 has trailing end **36*a*** supported by said second step and said first and third steps create vertical walls spaced apart from said clamp in parallel relation thereto.

The radially outermost wall of clamp 36 is denoted 46; it is a flat, bevelled surface. It performs the important function of applying to novel knife 48 the pressure applied to clamp 36 by fastener 28. The angle of surface 46 is offset from angled surface 60 such that when fastener 28 is tightened to its specified torque, sixty to eighty per cent of the clamping force is applied to the upper part of the knife and twenty to forty per cent to the lower part thereof.

Novel knife 48 has a parallelogram construction as shown. Acute angles form cutting edges 49, 51; each acute angle may be between twenty nine to thirty eight degrees. A transverse groove 54 is formed in top surface 50 and a similar groove 56 is formed in bottom surface 52. Groove 54 has beveled sides 77, 78 and groove 56 has bevelled sides 79, 80; each bevel is about forty five degrees. Note that grooves 54, 56 have a common depth and that the flat bottom of each groove 54, 56 is parallel to the surface 50, 52 within which it is formed. Thus, each groove has a leading, middle, and trailing surface. Moreover, the corner formed between surfaces 54 and 77, 54 and 78 and the corner formed between surfaces 56 and 79, 56 and 80 has a radius as depicted, i.e., said corners are rounded. Similarly, a radius is provided at each intersection of surface 50 and bevelled walls 77, 78 and each intersection of surface 52 and bevelled walls 79, 80. The knife exhibits longitudinal bilateral symmetry with respect to the center line appearing in FIG. 2; it also exhibits transverse bilateral symmetry with respect to a transverse line normal to said center line.

Counter knife 58 opposes the clamping force of clamp 36 and has a bevelled surface 60 that becomes parallel to bevelled surface 46 of clamp 36 when proper torque is applied to fastener member 30. A projecting ridge 62 at the radially outermost end of bevelled surface 60 has a leading, middle, and trailing surface that fits within groove 56 when knife 48 is positioned as depicted in FIG. 1, and fits within groove 54 when the knife is inverted upon wearing out of cutting edge 49. The opposite cutting edge 51 of knife 48 is exposed to the material to be chipped when the knife is reversed from its FIG. 1 position.

Figure 2:
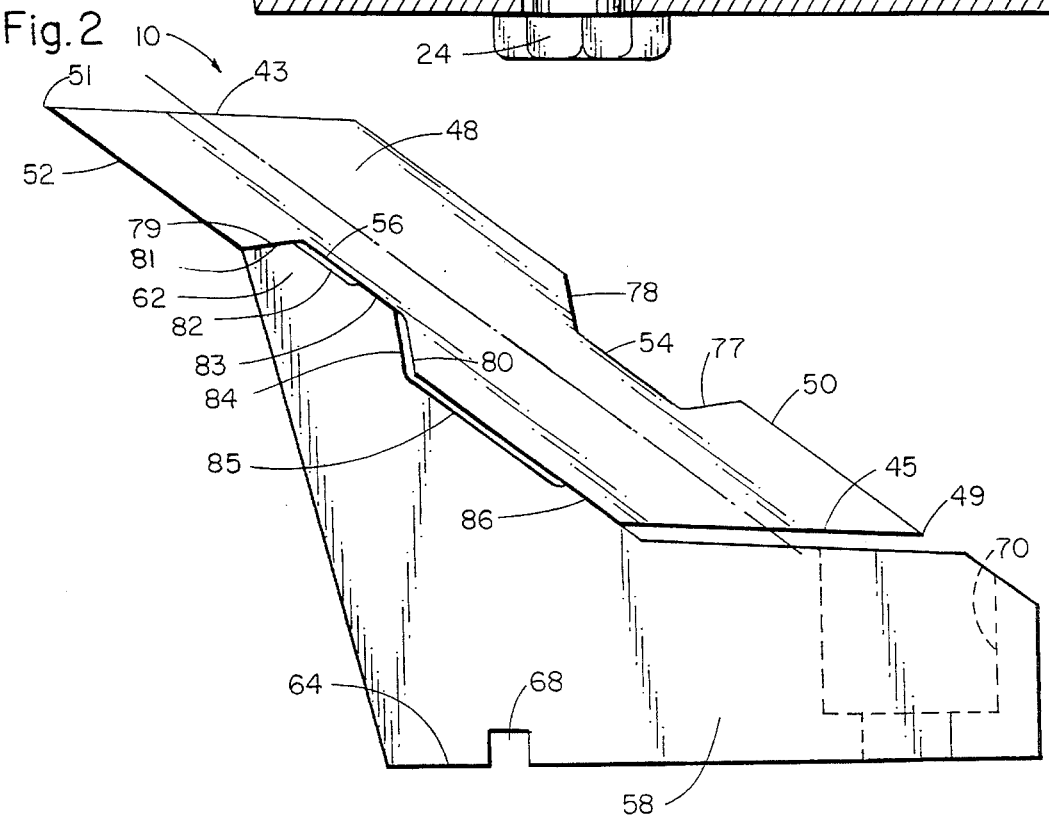
FIG. 2 is a side elevational view of the knife and counter knife shown in FIG. 1.

As disclosed in FIG. 2, a machined recess 82 is formed in middle surface 83 of projecting ridge 62, and a machined recess 84 is formed in the trailing surface of said projecting ridge. Moreover, a machined surface 85 is formed in bevelled clamping surface 86 of the counter knife, said machined surface 85 being in open communication with machined surface 84.

Ridge leading surface 81 is a contact surface for knife surfaces 77, 79; it prevents the knife from being pushed down between clamp 36 and counter knife 58. Ridge surface 83 is a contact surface for knife surfaces 54 and 56. Ridge surface 82 is parallel to but recessed from surface 83. Ridge surface 84 is a mating surface to knife surfaces 78, 80; it helps position the knife when mounting it and prevents the knife from moving outwardly. Surface 86 is a contact surface to knife surfaces 50 and 52. Surface 85 is parallel to but recessed from surface 86. A radius is applied to the intersections of surfaces 81 and 82, 82 and 83, 83 and 84, and between 84 and 85. The machined recesses 82, 84, and 85 reduce the tolerance requirements when the knife is manufactured and thus assure its optimal fit onto counter knife 58.

Significantly, projecting ridge 62, when fully seated within its mating groove 54 or 56 as depicted, substantially prevents entry of fiber into the space between blade surfaces 50 and 52, and abutting surfaces 46, 60, respectively.

Just as knife 48 will eventually wear out, so will counter knife 58. To provide facile replacement, counter knife 58 is positioned as at 64 in holder 18. A ridge 66 projects upwardly from holder 18 and is received within a groove 68 formed in the bottom surface of counter knife 58; the mating of the ridge and groove serve to properly position counter knife 58.

Counter knife 58 is countersunk as at 70 as shown to receive tool-engageable head 72 of fastener 74 that is received within hole 76; hole 76 extends through counter knife 58 and into holder 18; the part thereof that extends into said holder 18 is internally threaded; thus, advancing fastener 74 thereinto tightens counter knife 58 tightly to said holder 18. Just as importantly, replacement of counter knife 58 merely requires removal of fastener 74.

It is equally easy to remove fastener 28 to remove clamp 36 to enable removal or reversal of knife 48.

This invention is clearly new and useful. Moreover, it was not obvious to those of ordinary skill in this art at the time it was made.

It will thus be seen that the objects set forth above, and those made apparent by the preceding description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A chipper knife, comprising:

a body having a parallelogram shape;

said body having a first clamping surface of predetermined width, a second clamping surface of predetermined width, a pair of side walls, a leading surface, and a trailing surface;

a first cutting edge formed by a predetermined acute angle between said leading wall and said second clamping surface;

a second cutting edge formed by a predetermined acute angle between said trailing wall and said first clamping surface;

a first transverse groove formed in said first clamping surface;

said first transverse groove having a predetermined depth and having a flat bottom parallel to said first clamping surface;

a second transverse groove formed in said second clamping surface;

said second transverse groove having a flat bottom parallel to said second clamping surface and said second transverse groove having a depth substantially equal to the predetermined depth of said first transverse groove;

said knife having bilateral symmetry about a longitudinal axis of symmetry; and said knife having bilateral symmetry about a transverse axis of symmetry.

2. The knife of claim 2, wherein said first and second grooves each have transversely extending bevelled sidewalls disposed at a substantially forty five degree angle with respect to said first and second clamping surfaces.

3. The knife of claim 1, wherein each of Said predetermined acute angles is between twenty nine to thirty eight degrees.

4. The knife of claim 2, wherein said respective bevelled sidewalls and flat bottoms meet at a radius.

5. A counter knife mounted atop a counter knife holder, comprising:

a counter knife body having a countersunk hole formed therein;

said countersunk hole adapted to receive a fastener therethrough that secures said counter knife to said holder;

said counter knife being disposed in underlying relation to a knife;

a groove having three surfaces formed in said knife, said three surfaces including a leading, middle, and trailing surface;

a projecting ridge having three surfaces formed in said counter knife body, said three surfaces including a leading, middle, and trailing surface;

said projecting ridge adapted to fit within said groove in said knife to inhibit fiber intrusion between said knife and said counter knife;

a positioning ridge formed on said holder; and a positioning groove formed in a bottom wall of said counter knife for receiving said positioning ridge.

6. The counter knife of claim 5, further comprising a machined recess formed in said middle surface of said projecting ridge.

7. The counter knife of claim 5, further comprising a machined recess formed in said trailing surface of said projecting ridge.

8. The counter knife of claim 7, further comprising a machined recess formed in said counter knife, said machined recess formed in said counter knife being in open communication with the machined recess formed in said trailing surface of said projecting ridge.

9. The counter knife of claim 5, further comprising a radius formed in said projecting ridge where said leading and middle surfaces meet and where said middle and trailing surfaces meet.

10. A holder for holding a counter knife and a clamp, comprising:

a positioning ridge formed on said holder for engaging a complementally formed positioning groove formed in said counter knife;

a first threaded hole for receiving a first fastener that secures said counter knife to said holder;

a second threaded hole for receiving a second fastener that secures said clamp to said holder; and a third threaded hole for receiving a third fastener that secures said holder to a chipping disc.

11. The holder of claim 10, further comprising:

a recess formed in said holder for receiving said clamp;

a first, second, and third step formed in said recess, said clamp having a trailing end supported by said second step and said first and third steps defining walls spaced apart from said clamp in parallel relation thereto.

12. A clamp for clamping a knife in sandwiched relation between said clamp and a counter knife, said knife having a first clamping surface abutting said clamp and a second clamping surface abutting said counter knife, said first and second clamping surfaces of said knife having a predetermined longitudinal extent and a predetermined transverse extent, comprising:

said clamp having a bevelled surface that overlies said first clamping surface of said knife along its entire longitudinal and transverse extent.

13. The clamp of claim 12, further comprising a fastener for securing said clamp to said knife, and wherein said counter knife has a bevelled clamping surface that is slightly oblique to said bevelled surface of said clamp, a first end of said bevelled surface of said clamp squarely abutting said knife and a second end of said bevelled surface of said clamp not squarely abutting said knife until a predetermined torque is applied to said fastener.

* * * * *